US007066500B2

(12) United States Patent
Haber

(10) Patent No.: US 7,066,500 B2
(45) Date of Patent: Jun. 27, 2006

(54) VEHICLE DOOR LOCK

(75) Inventor: Greg Haber, Woodbury, NY (US)

(73) Assignee: Babaco Alarm Systems, Inc., Moonachie, NJ (US)

( * ) Notice: Subject to any disclaimer, the term of this patent is extended or adjusted under 35 U.S.C. 154(b) by 59 days.

(21) Appl. No.: 10/775,229

(22) Filed: Feb. 11, 2004

(65) Prior Publication Data

US 2005/0172683 A1 Aug. 11, 2005

(51) Int. Cl.
*E05C 19/10* (2006.01)
*E05B 13/10* (2006.01)

(52) U.S. Cl. ..... 292/106; 292/210; 292/216; 292/DIG. 23; 70/95; 70/210; 70/224

(58) Field of Classification Search ..... 292/210, 292/216, DIG. 22, DIG. 23, DIG. 67, 121–126, 292/129, 128, 123, 134, 106, 207, 236, 101–103; 70/95, 99, 100, 210, 224, 488, 478–480
See application file for complete search history.

(56) References Cited

U.S. PATENT DOCUMENTS

| | | | | |
|---|---|---|---|---|
| 1,489,965 | A * | 4/1924 | Prentice | 292/129 |
| 1,544,960 | A * | 7/1925 | Watts | 292/216 |
| 2,864,636 | A * | 12/1958 | Pickles | 292/216 |
| 3,012,804 | A * | 12/1961 | Jeavons | 292/DIG. 23 |
| 3,058,766 | A * | 10/1962 | Chanaryn et al. | 292/DIG. 23 |
| 3,270,536 | A * | 9/1966 | Abraham | 292/207 |
| 4,111,475 | A * | 9/1978 | McCormick et al. | 292/207 |
| 4,380,915 | A * | 4/1983 | Kincaid et al. | 70/224 |
| 4,508,296 | A * | 4/1985 | Clark | 292/207 |
| 4,691,541 | A * | 9/1987 | McQuade, Sr. | 292/207 |
| 4,948,184 | A * | 8/1990 | Weyerstall et al. | 292/216 |
| 5,024,473 | A * | 6/1991 | McQuade | 292/106 |
| 5,785,362 | A * | 7/1998 | Nadherny | 292/124 |
| 5,820,174 | A * | 10/1998 | Parikh et al. | 292/126 |
| 6,178,789 | B1 * | 1/2001 | Finkelstein et al. | 70/210 |
| 2003/0200777 | A1 * | 10/2003 | Waschgler | 70/210 |

FOREIGN PATENT DOCUMENTS

GB 2182706 A * 5/1987

* cited by examiner

*Primary Examiner*—Brian E. Glessner
*Assistant Examiner*—Christopher Boswell
(74) *Attorney, Agent, or Firm*—Robert L. Epstein; Epstein Drangel Bazerman & James, LLP

(57) ABSTRACT

A lock is provided for a vehicle having a door and a fixed part proximate the door. The lock includes a housing attached to the vehicle door. Latch means, including a hook, are mounted for rotation relative to the housing about an axis. The latch means rotates between a first position, wherein the hook engages a part of the vehicle to secure the door in the closed position, and a second position, wherein the hook is remote from the vehicle part such that the door can be opened. A latch rotation preventing member is moveable, relative to the housing, in a direction substantially parallel to the axis of rotation of the latch, between a forward position, remote from the path of movement of the latch means and a rear position, intersecting the path of the latch means to retain the latch means in its first position. Means are also provided for biasing the member toward the rear position.

14 Claims, 6 Drawing Sheets

VEHICLE DOOR LOCK

The present invention relates to a lock for the roll-up door of a truck or other vehicle and more particularly to such a lock that includes a rotatable latch and a latch rotation preventing member situated within a housing attached to the exterior of the door. The member is moveable in a direction parallel to the axis of latch rotation. It is spring loaded toward the rear of the lock housing, to a position intersecting the path of movement of the latch, to prevent the latch from being rotated to release the door. In that position, the member is extrememely difficult to dislodge by a tool inserted through the front of the housing, greatly increasing to the security provided by the lock.

Many vehicles, particularly trucks, have roll-up doors that permit entrance into the truck interior for the loading and unloading cargo. Locking devices of different types have been used to secure such roll-up doors in the closed position, to prevent unauthorized access to the truck interior.

The present invention relates to one type of locking device that is common used for that purpose. It is situated in a rectangular metal housing that is secured to the exterior surface of the truck door, adjacent the bottom of the door. The truck door jam has a recess into which a fixed part, in the form of a shaft or bar, is mounted.

Within the lock housing is situated a latch mounted for rotation about an axis that extends through the housing, from the front wall of the housing to the rear wall. The latch includes a hook designed to engage the vehicle part recessed in the door jam when the latch is in the "closed" position.

A handle, accessible from the exterior of the housing, is connected to rotate the latch between the "closed" position, wherein the hook engages the vehicle part to secure the door to the jam and the "open" position where the hook is remote from the vehicle part.

Also mounted within the housing is a key actuated lock cylinder. The lock cylinder can be rotated to permit a spring to move a member in a direction toward the front of the housing to intersect the path of the latch. In that forward position, the member blocks the rotational movement of the latch such that the hook is retained in engagement with the vehicle part in the door jam.

In order to protect the lock, the lock cylinder is located within a a strong cylindrical housing portion protruding from the front wall of the housing. However, like all locks, this type of lock can be attacked by thieves. If the perpetrator understands how the lock operates, an elongated tool, such as a screw driver, can be wedged through the key opening, along the side of the lock cylinder, and be used to push the latch rotation preventing member toward the rear of lock, against the spring. Moving the member backward, out of the path of movement of the latch, will permit the latch to be rotated to disengage the hook from the fixed part in the door jam, permitting the door to be opened.

In order to prevent this problem, and increase the security of the lock, I have redesigned the mechanism by spring loading the latch rotation preventing member toward the rear of the lock housing to a position in which it intersects the path of movement of the latch. With this change, even if a tool is inserted into the housing, and beyond the lock cylinder, the latch rotation preventing member cannot be pushed out of the path of the latch to permit the latch to rotate. This change greatly enhances the protection that the lock provides, without increasing the cost of complexity of the look.

It is, therefore, a prime object of the present invention to provide a vehicle door lock with enhanced security.

It is another object of the present invention to provide a vehicle door lock that achieves enhanced security without additional cost or complexity.

It is still another object of the present invention to provide a vehicle door lock that is more resistant to breach because the latch rotation preventing member cannot be dislodged by insertion of a tool through the front of the lock housing.

In accordance with one aspect of the present invention, a lock is provided for a vehicle having a door and a fixed part proximate the door. The lock includes a housing, with a front and a rear. The housing is attached to the vehicle door. Latch means including a hook are mounted for rotation relative to the housing about an axis. The latch means rotates between a first position, wherein the hook engages the vehicle part to secure the door in the closed position, and a second position, wherein the hook is remote from the vehicle part such that the door can be opened. A latch rotation preventing member is provided. That member is moveable, relative to the housing, in a direction substantially parallel to the axis of rotation of the latch, between a forward position, remote from the path of movement of the latch means and a rear position, intersecting the path of the latch means to retain the latch means in its first position. Means are also provided for biasing the member toward the rear position.

Means are also provided for locking the member in the rear position. The locking means includes a key actuated lock cylinder mounted for movement between a locked position and an unlocked position.

The locking means also includes a linkage part connected for movement with the lock cylinder. The linkage part has a cam surface. A cam, in the form of a protrusion extending from the latch rotation preventing member is in engagement with the cam surface. Preferrably, the rim of the linkage part forms the cam surface. The cam surface of the linkage part lies in a plane that is inclined relative to the linkage part axis.

The linkage part has a recess into which the lock cylinder is at least partially received. The lock also has a handle accessible from the exterior of the housing. The handle is connected to rotate the latch means.

The lock also includes spring means connected between the latch means and the housing. The spring means urges the latch means toward its first position, where the hook engages the vehicle part.

In accordance with another aspect of the present invention, a lock is provided for a vehicle having a door and a fixed part proximate the door. The lock includes a housing attached to the vehicle door. The housing has a front and a rear. Latch means are provided having a section mounted within the housing and rotatable about an axis extending between the front and rear of the housing. The latch means also includes a hook. A handle, accessible from the exterior of the housing, is connected to rotate the latch means along a path between a first position, wherein the hook engages the vehicle part to secure the vehicle door in the closed position and a second position, wherein the hook is remote from the vehicle part such that the door can be opened. A key actuated lock cylinder is mounted for movement between a locked position and an unlocked position. A member, operatively connected to the cylinder, is moveable relative to the housing, in a direction substantially parallel to the axis about which the latch means section rotates. The member is moveable between a forward position, remote from the path of movement of the latch means section, and a rear position, intersecting the path of movement of the latch means section, as the cylinder moves between the unlocked position and the locked position. Means are provided for biasing the member toward the rear position.

Means are also provided for connecting the cylinder and the member. The connecting means includes a linkage part connected for movement with the lock cylinder. The linkage part includes a cam surface. A cam, associated with the member, is in operative engagement with the cam surface.

The linkage part is rotatable about an axis. The cam surface is situated in a plane that is inclined relative to the linkage part axis.

The linkage part has a recess into which the lock cylinder is at least partially received.

The axis of the linkage part is substantially parallel to the axis about which the latch means section rotates.

The cam includes a protrusion extending from the member. The protrusion extends in a direction generally perpendicular to the axis of the member.

The lock also includes spring means operatively connected between the cover and the latch means.

To those and such other objects which may hereinafter appear, the present invention relates to a vehicle door lock, as described in detail in the following specification, and recited in the annexed claims, taken together with the accompanying drawings, in which like numbers refer to like parts, and in which:

Figure 1:
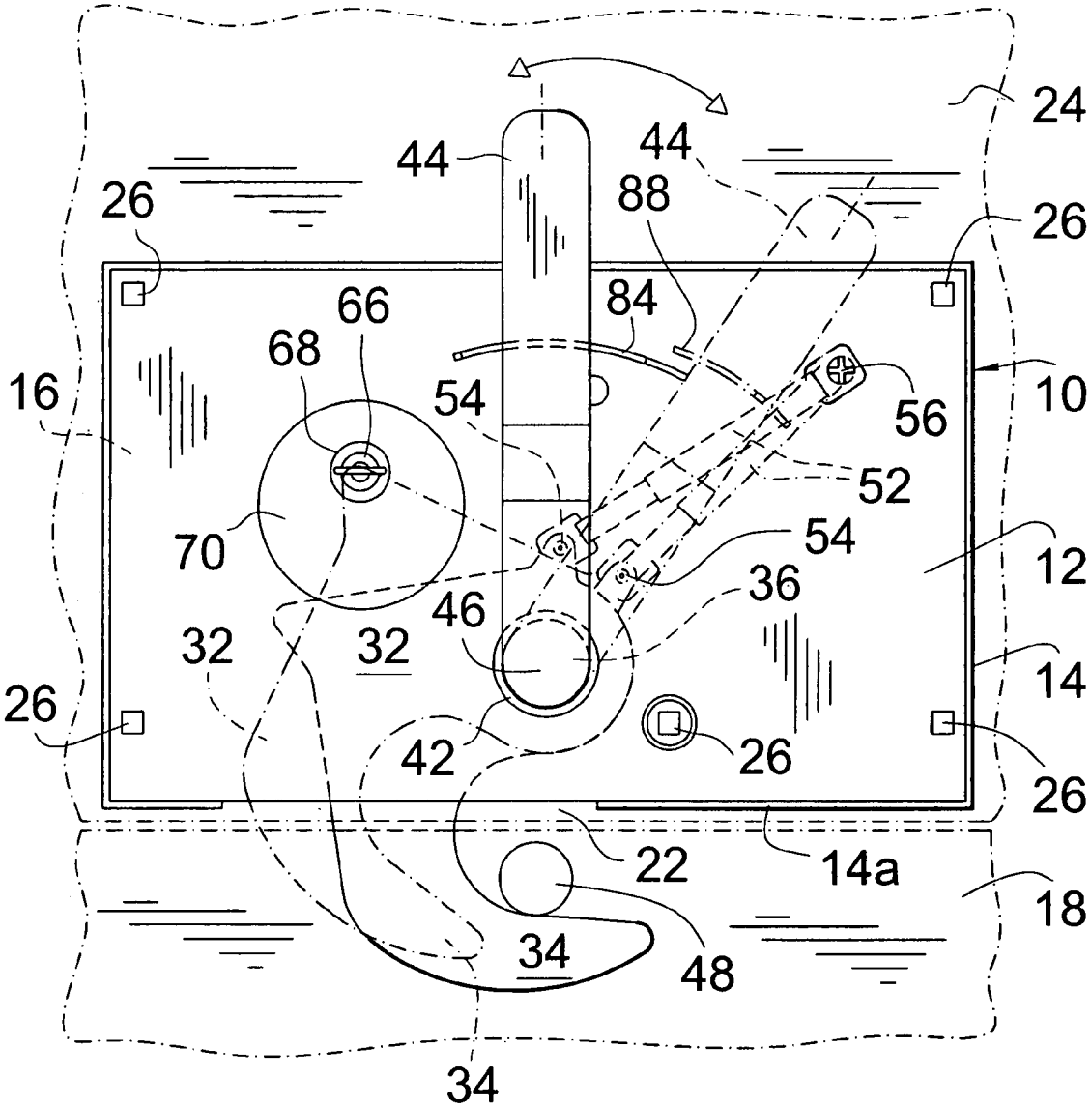
FIG. 1 is a front elevational view of the lock of the present invention, mounted on a vehicle door.

As seen in the drawings, the lock of the present invention includes a housing 10 consisting of a front wall 12, from which side walls 14 extend rearwardly, and a rear wall 16. The side wall 14*a* that faces the door jam 18 of the vehicle has an opening 22 through which the hook extends.

Housing 10 is fabricated of strong, heavy metal and is designed to be mounted on the exterior surface of the vehicle door 24 by means of a plurality of smooth headed bolts (not shown) that extend through openings 26 in housing front wall 12, openings 28 in housing rear wall 16 and through vehicle door 24 such that the nuts for those bolts are not accessible form the exterior of the door.

Latch 30 includes a body 32 and an integral hook 34. Latch body 32 is mounted on a large diameter shaft 36 situated within the housing. Shaft 36 is rotatably received at its rear within opening 38 in housing rear wall 16 and at its front by opening 40 in housing front wall 12. Opening 40 is defined by a collar 42 extending from the surface housing front wall 12.

A handle 44 is fixed to the front surface of shaft 36. Shaft 36, and hence latch body 32, rotates about an axis 46. As seen in FIG. 1, latch body 32 rotates in a clockwise direction as handle 44 is moved through an arc from a vertical position, where hook 34 engages part 48 in the vehicle door jam 18, to a position where hook 34 is remote and disengaged from vehicle part 48.

A spring 50, situated within a cylindrical cover 52, is pivotally connected between latch body 32, by pin 54, and housing front wall 12, by screw 56. Spring 50 biases latch body 32 towards the disengaged position of hook 34.

A latch rotation preventing member 58 is provided. Member 58 includes a substantially cylindrical upper body portion 58*a* and a lower, slightly smaller diameter, cylindrical portion 58*b*. Member 58 is moveable linearly along an axis 59, in a direction substantially parallel to the latch rotation axis 46.

Member 58 carries a radially extending protrusion 64. Protrusion 64 extends through and beyond an axially extending slot 62 in a tubular part 60, into which member 58 is moveably received. Tubular part 60 is fixedly mounted to the exterior of housing front surface 12, at a point within housing section 70. Slot 62 extends along a portion of the wall of part 60. As will become apparent, protrusion acts as a cam to determine the axial position of member 58 relative to tubular part 60 and hence the housing.

Figure 2:
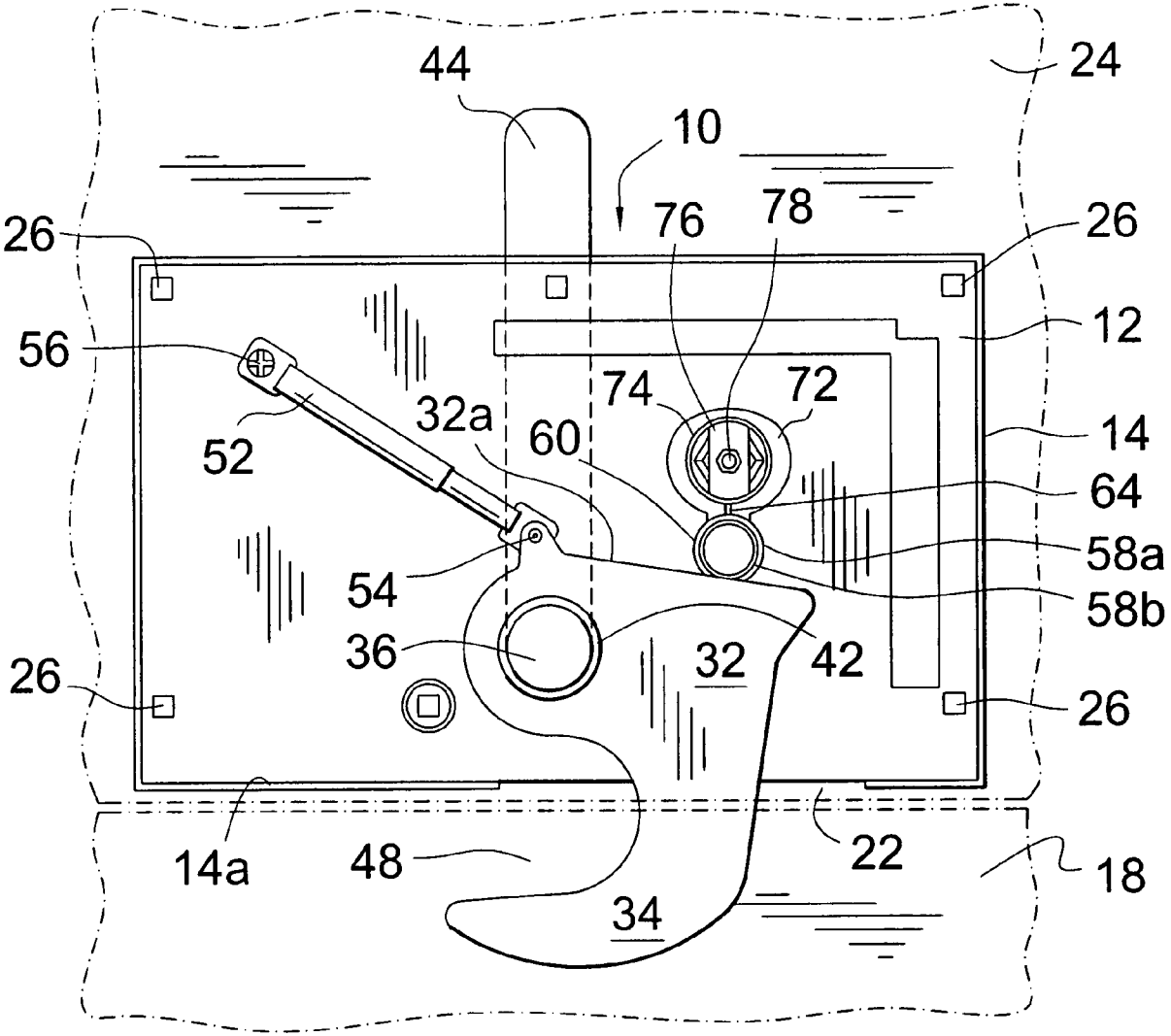
FIG. 2 is a rear view of the interior of the lock, showing the rotational position of the latch with the hook in the engaged position.
Figure 3:
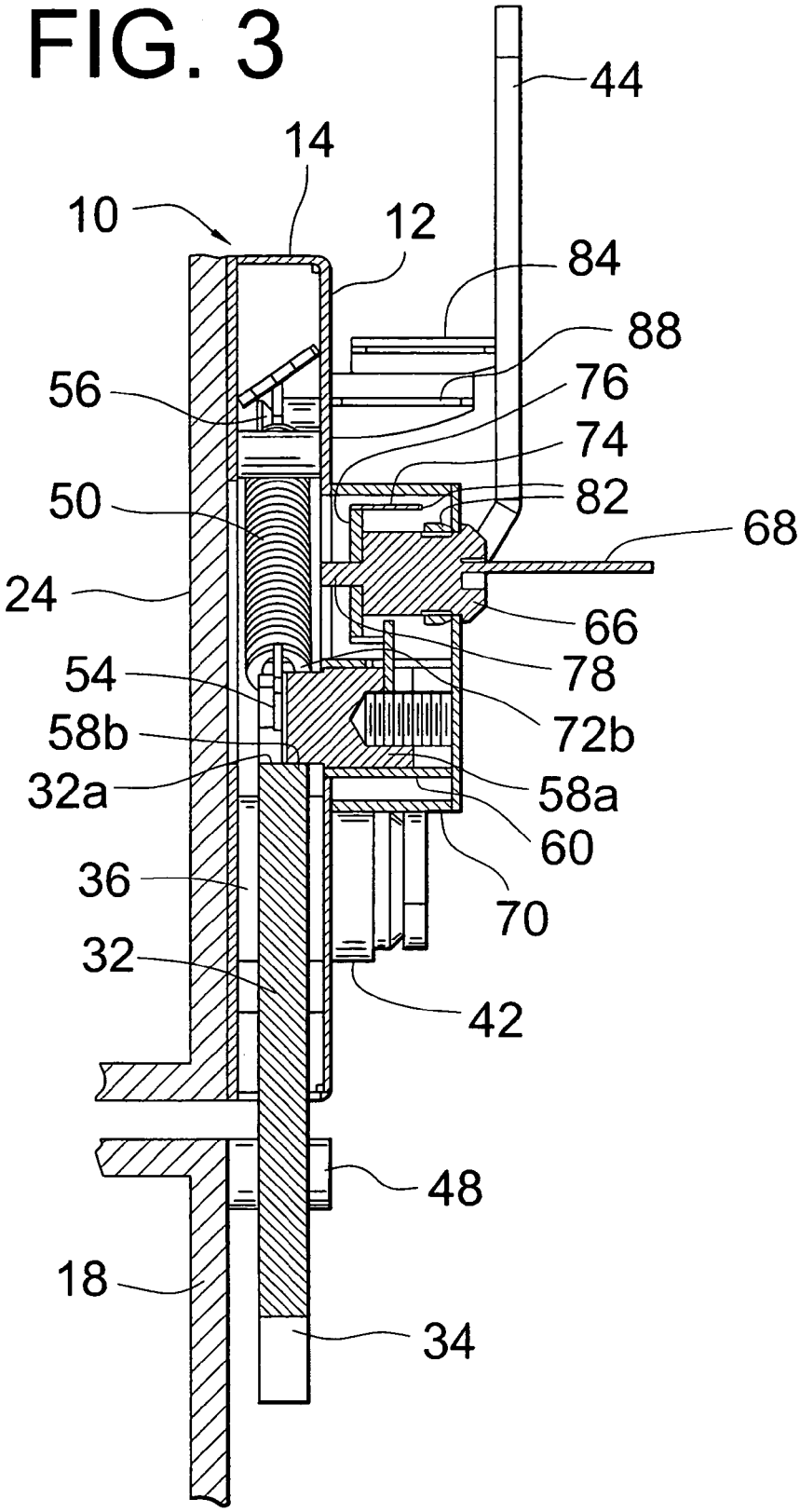
FIG. 3 is a cross-sectional view taken along line 3—3 of FIG. 1.

Member 58 moves within tubular part 60, along axis 59, between a forward position, in front of the plane of front housing wall, where it is remote from the rotational path of latch body 32, and a rear position, where portion 58*b* extends through opening 72 in housing front wall 12 (see FIG. 3) such that portion 58*b* intersects the rotational path of latch body 32. Axis 59 of member 58 is parallel to axis 46 of shaft 36. In the rear position of member 58, member portion 58*b* abuts side surface 32*a* of latch body 32 to prevent the latch body from moving hook 34 to disengage vehicle part 48 (see FIG. 2). A spring 65 biases member 58 toward its rear position.

Member 58, tubular part 60 and a lock cylinder 66, actuated by a key 68, are mounted within a cylindrical housing section 70. Housing section 70 is fabricated of strong, heavy metal, like the remiander of housing 10, and is welded to the exterior surface of housing front wall 12.

Figure 4:
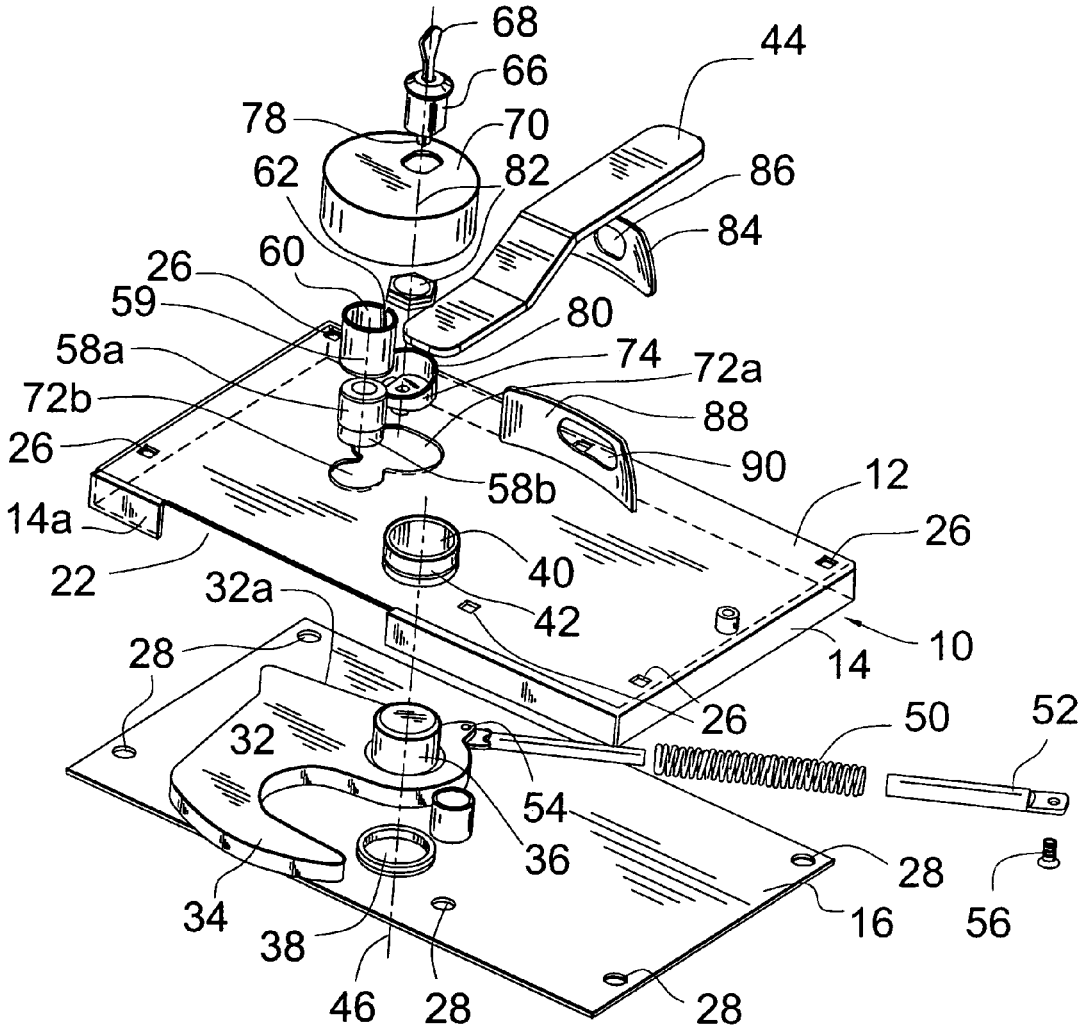
FIG. 4 is a prospective exploded view of the lock mechanism, as seen from the front.
Figure 5:
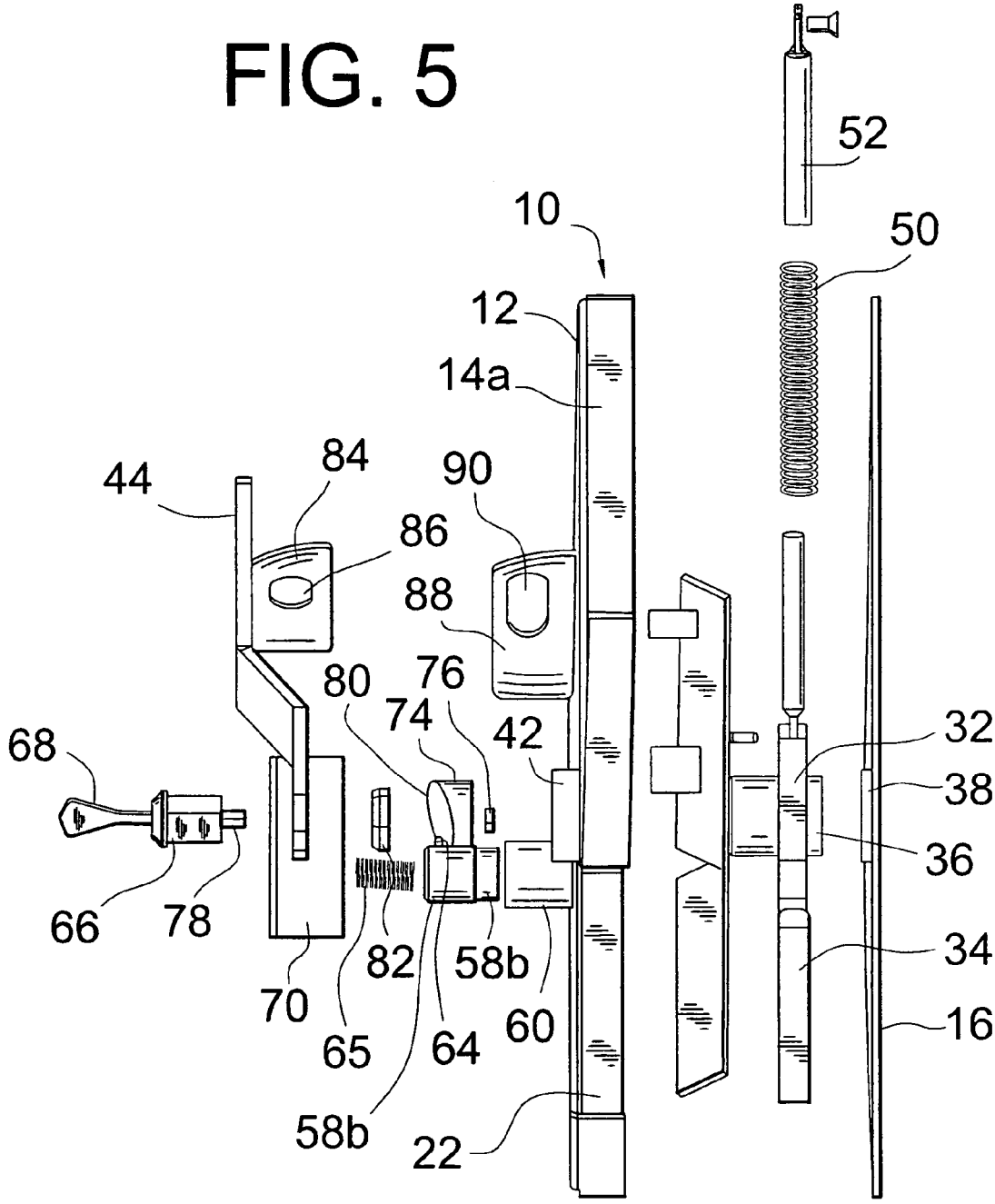
FIG. 5 is an exploded view of the lock mechanism, as seen from the bottom.

An opening 72 (FIG. 4) is provided in the portion of housing front wall 12 situated under housing section 70. Opening 72 is in the shape of two contiguous circles 72*a* and 72*b*. Opening section 72*b* has a smaller diameter than section 72*a*. The diameter of section 72*b* is large enough to permit passage of lower portion 58*b* of member 58, but not the upper, larger diameter portion 58*a*. Thus, the upper portion 58*a* of member 58 is retained within housing section 70, in front of housing front wall 12, whereas portion 58*b* of member 58 can protrude through opening portion 72*b*, into the interior of housing 10, to intersect the path of latch body 32, when member 58 is in the rear position.

Also situated within housing section 70 is a rotatable hollow linkage part 74. Part 74 is cylindrical in shape and has a flat element 76 extending across its open bottom (see FIG. 2). Lock cylinder 66 has a protrusion 78 extending from its bottom surface. Lock cylinder 66 is received within part 74, with protrusion 78 extending through and non-rotably engaging an opening in element 76, such that part 74 rotates with cylinder 66, as key 68 rotates cylinder 66.

Figure 6:
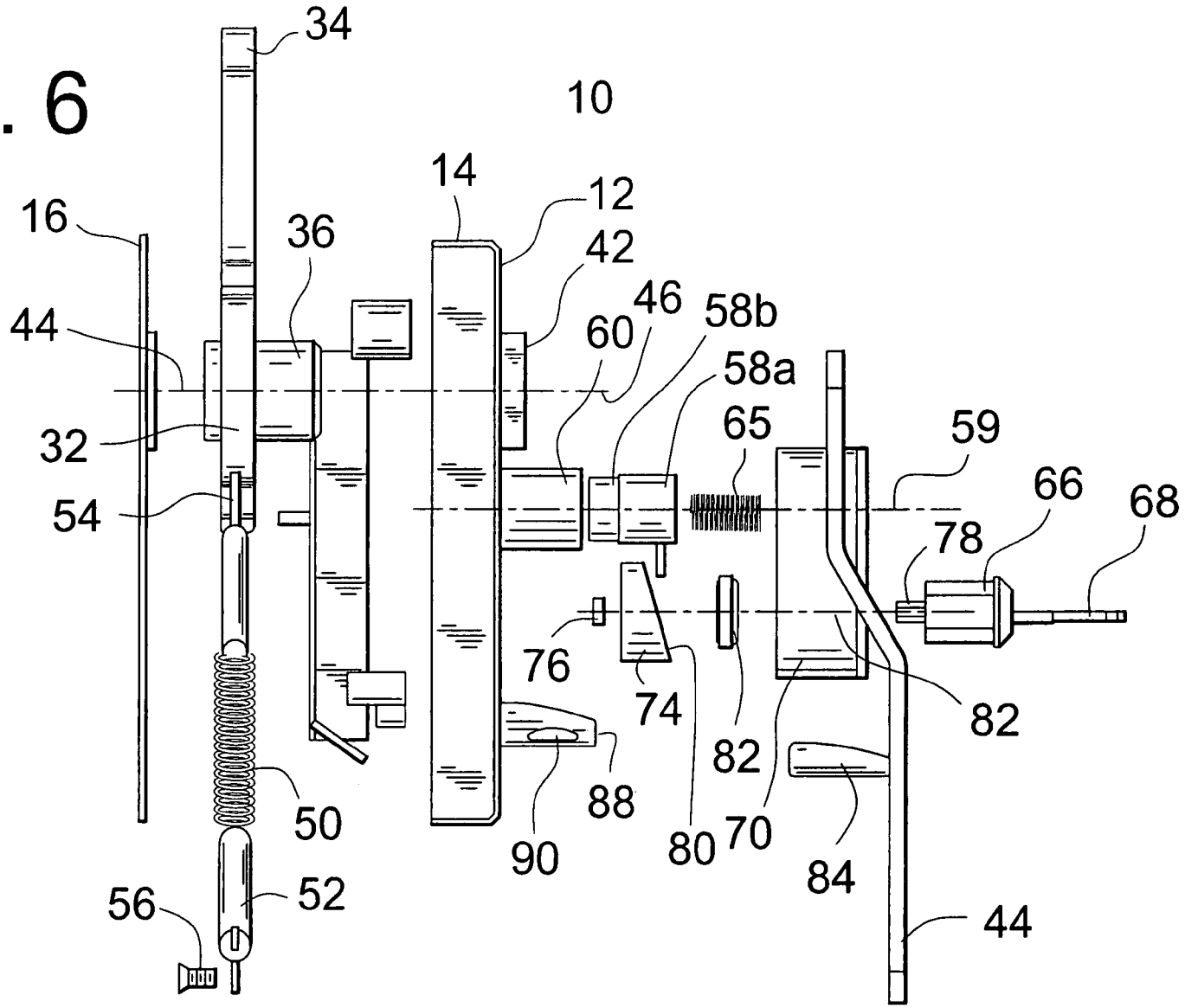
FIG. 6 is an exploded view of the lock mechanism, as seen from the side.

Part 74 has a rim 80 which is inclined relative to the axis 82 of cylinder 66 and which is also the axis of rotation of part 74 (see FIG. 6). Rim 80 of part 74 acts as a cam surface for protrusion 64. Thus, as cylinder 66 rotates part 74, protrusion 64 rides along rim 80 causing member 58 to move back and forth along axis 59. When cylinder 66 is in the "locked" position, part 74 frees protrusion 64 such that spring 65 moves member 58 linearly to its rear position, with portion 58*b* extending through opening portion 72*a* and intersecting the path of latch body 32, preventing latch body 32 from rotating to cause hook 34 to disengage vehicle part 48. When cylinder 66 rotates from its "locked" position, part 74 rotates, causing protrusion 64 to move member 58 to its forward position, against the urging of spring 65, and portion

58*b* of member 58 to move out of the path of latch body 32, permitting latch body 32 to rotate and hook 34 to disengage vehicle part 48.

A nut 82 is situated within housing 70. Nut 82 secures lock cylinder 66 within housing section 70.

Welded to the undersurface of handle 44 is an arcuate member 84 with an opening 86. Welded to the exterior surface of housing front wall 12 is a similarly shaped arcuate member 88 with an opening 90. When handle 44 is in the "closed" position, members 84 and 88 are situated in side by side relation, with openings 86 and 90 in alignment. A padlock can be positioned through openings 86 and 90 to prevent members 84 and 88 from moving apart and hence handle 44 from rotating latch body 32, as an extra security device, if desired.

It will now be appreciated that because in the "locked" state of the mechanism of the present invention, spring 65 biases member 58 toward it rear position, causing portion 58*b* to intersect the path of movement of latch body 32. Insertion of a tool through the key opening in housing section 70 cannot move member 58 forward such that the latch body can be rotated, because member 58 has no portion that can be engaged by the tool to move the rotation preventing member forward. Accordingly, the lock cannot be breached in this manner.

While only a single preferred embodiment of the present invention has been disclosed for purposes of illustration, it is obvious that many variations and modifications could be made thereto. It is intended to cover all of these variations and modifications that fall within the scope of the invention, as defined by the following claims:

I claim:

1. A lock for a vehicle having a door having an exterior surface and a fixed part proximate the door, the lock comprising a housing with a front wall and a rear wall, attached to the vehicle door with said rear wall proximate said exterior surface of said door; latch means comprising a hook, said latch means being mounted in said housing, for rotational movement about an axis, between a first rotational position, wherein said hook engages the part to secure the door in the closed position and a second rotational position wherein said hook is remote from the part such that the door can be opened; a latch rotation preventing member linearly moveable relative to said housing, in a direction substantially parallel to said axis of rotation of said latch means, between a position spaced from said rear wall of said housing, remote from the path of movement of said latch means and a position proximate to said rear wall of said housing, intersecting the path of said latch means, to retain said latch means in its said first rotational position; and means for biasing said member toward said position proximate said rear wall of said housing, further comprising means for locking said member in said position proximate said rear wall of said housing, wherein said locking means comprises a key actuated lock cylinder mounted for movement between a locked position and an unlocked position, and wherein said locking means further comprises a linkage part connected for movement with said lock cylinder and comprising a cam surface, where said locking means is axillary offset from said latch rotation preventing member.

2. The lock of claim 1 further comprising a cam on said member, in engagement with said cam surface.

3. The lock of claim 2 wherein said cam surface comprises the rim of said linkage part.

4. The lock of claim 3 wherein said linkage part comprises an axis and wherein said rim of said linkage part lies in a plane that is inclined relative to said linkage part axis.

5. The lock of claim 1 wherein said linkage part comprises a recess into which said lock cylinder is at least partially received.

6. The lock of claim 1 further comprising a handle accessible from the exterior of the housing and connected to rotate said latch means.

7. The lock of claim 1 further comprising spring means connected between said latch means and said housing.

8. A lock for a vehicle having a door and a fixed part proximate the door, the lock comprising a housing attached to the vehicle door and having a front and a rear; latch means comprising a section, mounted within said housing and rotatable about an axis extending between the front and rear of said housing, and a hook; a handle accessible from the said front of said housing and connected to rotate said section along a path between a first position, wherein said hook engages the part to secure the vehicle door in the closed position and a second position, wherein the hook is remote from the part such that the door can be opened; a key actuated lock cylinder mounted in said housing for movement between a locked position and an unlocked position; a member, operatively connected to said cylinder, linearly moveable relative to said housing in a direction substantially parallel to said axis about which said section rotates, between a position spaced from said rear of said housing, remote from said path, and a position proximate said rear of said housing, intersecting said path, as said cylinder moves between said unlocked position and said locked position, and means for biasing said member toward said position proximate said rear of said housing, wherein said key actuated lock cylinder is axillary offset from said member, further comprising means operatively connecting said cylinder and said member; wherein said connecting means comprises a linkage part connected for movement with said lock cylinder, a cam surface on said linkage part and a cam associated with said member, in operative engagement with said cam surface.

9. The lock of claim 8 wherein said linkage part is rotatable about an axis and wherein said cam surface is situated in a plane inclined relative to said linkage part axis.

10. The lock of claim 9 wherein said linkage part has a recess into which said lock cylinder is at least partially received.

11. The lock of claim 9 wherein said axis of said linkage part is substantially parallel to said axis about which said section rotates.

12. The lock of claim 8 wherein said cam comprises a protrusion extending from said member.

13. The lock of claim 12 wherein said member has an axis and wherein said protrusion extends in a direction generally perpendicular to said axis of said member.

14. The lock of claim 8 further comprising spring means operatively connected between said housing and said latch means.

* * * * *